US006985118B2

(12) United States Patent
Zarro et al.

(10) Patent No.: US 6,985,118 B2
(45) Date of Patent: Jan. 10, 2006

(54) MULTI-BAND HORN ANTENNA USING FREQUENCY SELECTIVE SURFACES

(75) Inventors: Michael S. Zarro, Melbourne Beach, FL (US); Heriberto J. Delgado, Melbourne, FL (US); William D. Killen, Melbourne, FL (US)

(73) Assignee: Harris Corporation, Melbourne, FL (US)

( * ) Notice: Subject to any disclaimer, the term of this patent is extended or adjusted under 35 U.S.C. 154(b) by 15 days.

(21) Appl. No.: 10/614,626

(22) Filed: Jul. 7, 2003

(65) Prior Publication Data

US 2005/0007289 A1 Jan. 13, 2005

(51) Int. Cl.
*H01Q 19/00* (2006.01)

(52) U.S. Cl. ..... 343/756; 343/771; 343/786; 343/909; 333/137

(58) Field of Classification Search ..... 343/700 MS, 343/756, 786, 909, 771; 33/21 A, 125, 134, 33/137, 202
See application file for complete search history.

(56) References Cited

U.S. PATENT DOCUMENTS 3,581,243 A 5/1971 Alford
3,681,716 A 8/1972 Chiron et al.
3,754,271 A * 8/1973 Epis ..... 343/756

(Continued)

FOREIGN PATENT DOCUMENTS

EP 0 754 660 A1 1/1997
EP 1 089 374 A2 4/2001
EP 1 108 533 6/2001

(Continued)

OTHER PUBLICATIONS

U.S. Appl. No. 10/448,973, filed May 30, 2003, Delgado et al.
U.S. Appl. No. 10/184,277, filed Jun. 27, 2002, Killen et al.
U.S. Appl. No. 10/185,443, filed Jun. 27, 2002, Killen et al.
U.S. Appl. No. 10/184,332, filed Jun. 27, 2002, Killen et al.
U.S. Appl. No. 10/185,251, filed Jun. 27, 2002, Parsche et al.
U.S. Appl. No. 10/185,847, filed Jun. 27, 2002, Killen et al.
U.S. Appl. No. 10/185,275, filed Jun. 27, 2002, Killen et al.
U.S. Appl. No. 10/185,273, filed Jun. 27, 2002, Killen et al.
U.S. Appl. No. 10/308,500, filed Dec. 3, 2002, Killen et al.
U.S. Appl. No. 10/373,935, filed Feb. 25, 2003, Killen et al.
U.S. Appl. No. 10/404,285, filed Mar. 31, 2003, Killen et al.
U.S. Appl. No. 10/404,981, filed Mar. 31, 2003, Killen et al.
U.S. Appl. No. 10/404,960, filed Mar. 31, 2003, Killen et al.
U.S. Appl. No. 10/185,144, filed Jun. 27, 2002, Killen et al.
U.S. Appl. No. 10/185,266, filed Jun. 27, 2002, Killen et al.
U.S. Appl. No. 10/185,162, filed Jun. 27, 2002, Rumpf, Jr. et al.
U.S. Appl. No. 10/185,824, filed Jun. 27, 2002, Killen et al.
U.S. Appl. No. 10/185,187, filed Jun. 27, 2002, Killen et al.

(Continued)

*Primary Examiner*—Tan Ho
(74) *Attorney, Agent, or Firm*—Sacco & Associates, PA

(57) ABSTRACT

A waveguide (100) including at least one outer surface (105, 110, 115, 120) defining a waveguide cavity (140) and at least one inner surface (130, 135) positioned within the waveguide cavity (140). The inner surface (130, 135) includes a frequency selective surface (FSS) having a plurality of FSS elements (145) coupled to at least one substrate. The substrate defines a first propagation medium such that an RF signal having a first wavelength in the first propagation medium can pass through the FSS (130, 135). The FSS (130, 135) is coupled to a second propagation medium such that in the second propagation medium the RF signal has a second wavelength which is at least twice as long as a physical distance between centers of adjacent FSS elements (145). The second wavelength can be different than the first wavelength.

21 Claims, 7 Drawing Sheets

U.S. PATENT DOCUMENTS

| | | | | | |
|---|---|---|---|---|---|
| 4,633,264 | A | * | 12/1986 | Imazeki et al. | 343/786 |
| 4,638,271 | A | | 1/1987 | Jecko et al. | |
| 4,707,702 | A | * | 11/1987 | Withers | 343/786 |
| 4,967,171 | A | | 10/1990 | Ban et al. | |
| 5,714,112 | A | | 2/1998 | Hazeyama et al. | |
| 5,949,387 | A | * | 9/1999 | Wu et al. | 343/909 |
| 6,025,809 | A | * | 2/2000 | Lane et al. | 343/772 |
| 6,208,316 | B1 | * | 3/2001 | Cahill | 343/909 |
| 6,396,451 | B1 | * | 5/2002 | Wu et al. | 343/756 |
| 6,512,494 | B1 | * | 1/2003 | Diaz et al. | 343/909 |
| 6,563,472 | B2 | * | 5/2003 | Durham et al. | 342/781 P |

FOREIGN PATENT DOCUMENTS

| | | |
|---|---|---|
| JP | 56-123102 | 9/1981 |
| JP | 05-211402 | 8/1983 |
| JP | 07-015218 | 1/1995 |
| JP | 08-154006 | 6/1996 |
| JP | 08 307117 | 11/1996 |
| JP | 10/190321 | 7/1998 |
| JP | 2000307362 | 11/2000 |
| WO | PCT/GB92/01173 | 6/1992 |
| WO | WO 01/01453 A2 | 1/2001 |

OTHER PUBLICATIONS

"*Wave guidance and radiation from a hollow tube formed from frequency–selective surfaces,*" A.J. Robinson, J.C. Vardaxoglou, and R.D. Seager, Electronics Letters, Aug. 19, 1993, vol. 29, No. 17.

"*Realisation of frequency selective horn antenna incited from passive array,*" J.C. Vardaxoglou, R.D. Seager and A.J. Robinson, Electronics Letters, Oct. 8, 1992, vol. 28, No. 21.

"*Development of a 7.2–, 8.4–, and 32–Gigahertz (X–/X–/Ka–BAnd) Three–Frequency Feed for the Deep Space Network,*" Stanton, P.H.; Hoppe, D.J., and Reilly, H. TMO Progress Report 42–145, May 15, 2001.

"*Frequency Selective Surfaces in the GHz and the THz Region: Analysis and Experimental Results,*" Bozzi, Maurizio and Perregrini, Luca, Terahertz and Gigahertz Electronics and Photonics, II. Proceedings of SPIE Vo. 4111 (2000).

"*Arrays of Concentric Rings as Frequency Selective Surfaces,*" Parker, E.A., Hamday, S.M.A., and Langley, R.J. Electronics Letters, Nov. 12, 1981, vol. 17, No. 23.

"*Single–Layer Multiband Frequency–Selective Surfaces,* " Lee, C.K., Langley, R.J., and Parker, E.A. IEE Proceedings, Vo. 132, Pt. H. No. 6, Oct. 1985.

"*Frequency Selective Surfaces,*" Parker, E.A., Langley, R.J., Cahill, R., and Vardaxoglou, J.C. Electronics Laboratories, The University of Kent, Canterbury, UK. p. 459.

"*Novel for 'Soft' Horn Antenna for Multiband Operation,*" Vardaxoglou, J.C., Seager, Robert D., Robinson, Alan J. Loughborough University of Technology, Department of Electronic and Electrical Engineering, Loughborough Leicestershire LE 11 3TU.

Itoh, T.; et al: "Metamaterials Structures, Phenomena and Applications" IEEE Transactions on Microwave Theory and Techniques; Apr. 2005; [Online}Retrieved from the Internet: URL.www.mtt.org/publications/Transactions/CFP_ Metamaterials.pdf>.

Kiziltas, G.; et al: "Metamaterial design via the density method" IEEE Antennas and Propagation Society Int'l Symposium 2002, vol. 1, Jun. 16, 2002, pp 748–751, Piscataway.

Salahun, E.; et al: "Ferromagnetic composite–based and magnetically–tunable microwave devices" IEEE MTT–S Microwave Symposium Digest, vol. 2, Jun. 2, 2002, pp 1185–1188.

* cited by examiner

MULTI-BAND HORN ANTENNA USING FREQUENCY SELECTIVE SURFACES

BACKGROUND OF THE INVENTION

1. Statement of the Technical Field

The inventive arrangements relate generally to methods and apparatus for horn antennas, and more particularly to horn antennas which can operate in multiple frequency bands.

2. Description of the Related Art

Conventional electromagnetic waveguides and horn antennas are well known in the art. A waveguide is a transmission line structure that is commonly used for microwave signals. A waveguide typically includes a material medium that confines and guides a propagating electromagnetic wave. In the microwave regime, a waveguide normally consists of a hollow metallic conductor, usually rectangular, elliptical, or circular in cross section. This type of waveguide may, under certain conditions, contain a solid, liquid, liquid crystal or gaseous dielectric material.

In a waveguide, a "mode" is one of the various possible patterns of propagating or standing electromagnetic fields. Each mode is characterized by frequency, polarization, electric field strength, and magnetic field strength. The electromagnetic field pattern of a mode depends on the frequency, refractive indices or dielectric constants and relative permeabilities, and waveguide or cavity geometry. With low enough frequencies for a given structure, no transverse electric or transverse magnetic mode will be supported. At higher frequencies, higher modes are supported and will tend to limit the operational bandwidth of a waveguide. Each waveguide configuration can form different transverse electric and transverse magnetic modes of operation. The most useful mode of propagation is called the Dominant Mode. Other modes with different field configurations can occur unintentionally or can be caused deliberately.

In operation, a waveguide will have field components in the x, y, and z directions. A rectangular waveguide will typically have waveguide dimensions of width, height and length represented by a, b, and l respectively. The cutoff frequency or cutoff wavelength (for transverse electric (TE) modes) can be represented as:

$$(f_c)_{mn} = \frac{1}{2\pi\sqrt{\mu\varepsilon}}\sqrt{\left(\frac{m\pi}{a}\right)^2 + \left(\frac{n\pi}{b}\right)^2}$$

and $$(\lambda_c)_{mn} = \frac{2}{\sqrt{\left(\frac{m}{a}\right)^2 + \left(\frac{n}{b}\right)^2}}$$

where a is the width of the wider side of the waveguide, and b is a width of the waveguide measured along the narrow side, c is the speed of light, $\epsilon$ and $\mu$ are the permittivity and permeability of the dielectric inside the waveguide, and m, n are mode numbers. The lowest frequency mode in a waveguide is the $TE_{10}$ mode. In this mode, the equation for the signal wavelength at the cutoff frequency reduces to $\lambda_c$=2a. Since waveguides are generally designed to have a static geometry, the operational frequency and bandwidth of conventional waveguides is limited.

Horn antennas are essentially open-ended waveguides in which the walls are gradually flared outwardly toward the radiating aperture. Horn antennas can be designed to support a particular mode, depending on the desired antenna radiation pattern. Generally, horn antennas operate at a specific frequency or within a frequency band.

To overcome the frequency and bandwidth limitations, International Patent Application No. PCT/GB92/01173 assigned to Loughborough University of Technology (Loughborough) proposes that a frequency selective surface (FSS) can be used within a waveguide to influence the frequency response. An FSS is typically provided in one of two arrangements. In a first arrangement, two or more layers of conductive elements are separated by a dielectric substrate. The elements are selected to resonate at a particular frequency at which the FSS will become reflective. The distance between the element layers is selected to create a bandpass condition at a fundamental frequency at which the FSS becomes transparent and passes a signal. The FSS also can pass harmonics of the fundamental frequency. For example, if the fundamental frequency is 10 GHz, the FSS can pass 20 GHz, 30 GHz, 40 GHz, and so on. Of course, if one of the harmonic frequencies happens to coincide with the resonant frequency of the elements, for example if the elements are selected to resonate at 30 GHz, the FSS will be reflective and not pass that particular frequency.

Alternatively, FSS elements can be apertures in a conductive surface. The dimensions of the apertures can be selected so that the apertures resonate at a particular frequency. In this arrangement, the FSS elements pass signals propagating at the resonant frequency. Any other electromagnetic waves incident on the FSS surface are reflected from the surface.

In a multi-band waveguide or horn antenna, the FSS can form a second horn within a first horn wherein the second horn and first horn are tuned to different frequencies. This concept is not without its drawbacks, however. In particular, the horn proposed by Loughborough can generate grating lobes, which is electromagnetic energy that is scattered to uncontrolled directions. Grating lobes result from transmitted and scattered plane waves which do not obey Snell's laws of reflection and refraction. Causes of grating lobes are relatively large inter-element spacing within the FSS, large angles of incidence of plane wave with respect to surface, and/or both. Importantly, grating lobes adversely effect horn antenna performance and should be avoided. Accordingly, there exists a need for waveguides and horn antennas which can incorporate FSS's for multi-band operation, yet which can operate without generating grating lobes.

SUMMARY OF THE INVENTION

The present invention relates to a waveguide, which can be a horn antenna, including at least one outer surface defining a waveguide cavity and at least one inner surface positioned within the waveguide cavity. The inner surface includes a frequency selective surface (FSS) having a plurality of FSS elements coupled to at least one substrate. The substrate defines a first propagation medium such that an RF signal having a first wavelength in the first propagation medium can pass through the FSS. The FSS is coupled to a second propagation medium such that in the second propagation medium the RF signal has a second wavelength which is at least twice as long as a physical distance between centers of adjacent FSS elements. The second wavelength can be different than the first wavelength. Further, the substrate can include a dielectric having a relative permittivity and/or a relative permeability which is greater than 3.

The FSS can include a plurality of dielectric layers and/or a plurality of FSS element layers. The FSS elements can include conductive elements and/or apertures in a conductive surface. The FSS can further include at least one dielectric layer for matching an impedance of the first propagation medium to an impedance of the second propagation medium.

The present invention also relates to an antenna for microwave radiation which includes a first horn and at least a second horn which is positioned within the first horn. The second horn includes at least one frequency selective surface (FSS) having a plurality of FSS elements coupled to at least one substrate. The substrate defines a first propagation medium such that an RF signal having a first wavelength in the first propagation medium can pass through the FSS. The FSS is coupled to a second propagation medium such that in the second propagation medium the RF signal has a second wavelength. The antenna can further include at least a third horn positioned within the second horn, the third horn including at least one FSS.

Again, the FSS can include a plurality of dielectric layers, including at least one dielectric layer for matching an impedance of the first propagation medium to an impedance of the second propagation medium. The FSS elements can include conductive elements and/or apertures in a conductive surface. The FSS can further include a plurality of FSS element layers.

The present invention also relates to a waveguide horn antenna which includes a tapered hollow metallic conductor, a FSS including a substrate, and an array of elements defining at least one wall of the horn. The waveguide can be filled with a material having a permeability and a permittivity of about 1. The FSS can include concentric ring slots and is positioned for confining and guiding a propagating electromagnetic wave. A grating lobe of the antenna is reduced by increasing a permeability and/or a permittivity of the substrate to a value greater than about three. Further, at least one grating lobe of the antenna can be reduced by decreasing a spacing between adjacent elements of the FSS.

The value of the permeability and/or the permittivity can be selected to improve broadband performance of the FSS. For example, the permeability and/or the permittivity can be selected so that the FSS has a percentage bandwidth of at least 45%. The value of the permeability and/or the permittivity can be between about 10 and 100. Further, the permeability and/or the permittivity can be selected for improved performance of RF signals having an angle of incidence ranging from about 20 to 40 degrees relative to a plane which is perpendicular to the FSS.

DETAILED DESCRIPTION OF THE PREFERRED EMBODIMENTS

The present invention concerns a waveguide including a frequency selective surface (FSS), which comprises FSS elements having relatively small inter-element spacing for a given operational frequency. As compared to conventional FSS's, the small inter-element spacing increases FSS bandwidth and eliminates grating lobes by displacing them to higher frequencies. Further, FSS performance with respect to signal angle of incidence is improved.

Figure 1:
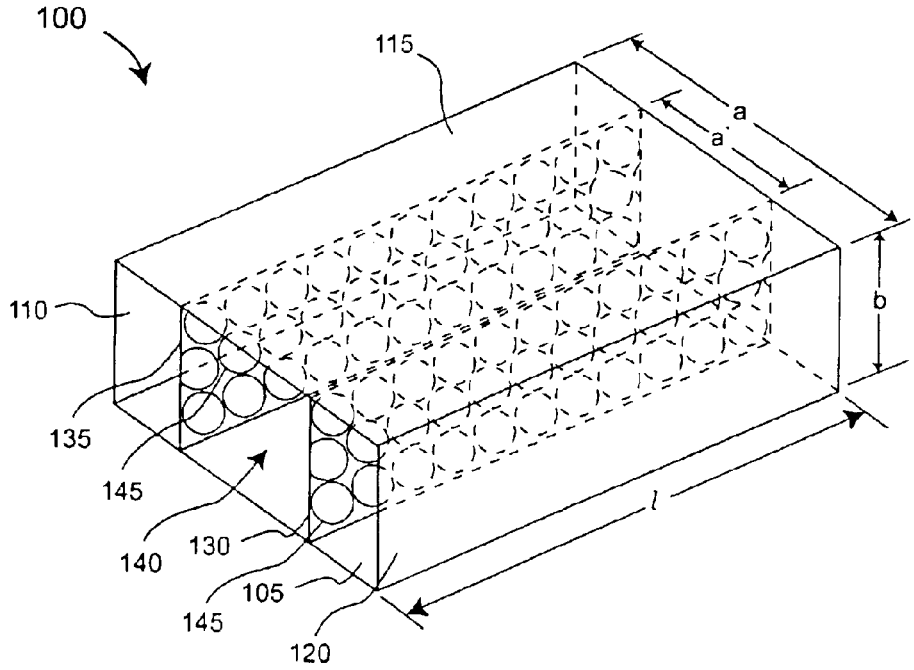
FIG. 1 is a perspective view of a multi-band waveguide that is useful for understanding the present invention.

Referring to FIG. 1, an exemplary multi-band waveguide (waveguide) 100 including FSS's 130, 135 is shown. The exemplary waveguide 100 has a rectangular cross section, however, the present invention is not so limited. Importantly, the present invention can be a waveguide having any suitable configuration defining a waveguide cavity 140. For example, the waveguide can have a cross section which is round, square, elliptical, triangular, or any other suitable shape. Further, the waveguide cavity 140 can be filled with a dielectric material or the waveguide cavity 140 can be unfilled.

The waveguide 100 can include at least one outer surface, such as outer surfaces 105, 110, 115, 120. The outer surfaces 105, 110, 115, 120 can be conductive surfaces, dielectric surfaces, FSS's, a combination of such surfaces, and/or any other surface which can be used to propagate TEM signals. Accordingly, in the $TE_{10}$ mode, a signal wavelength at a first cutoff frequency of the waveguide can be given by the equation $\lambda_c=2a$.

FSS's 130, 135 can be placed within the waveguide to change the effective dimensions of the waveguide when certain types of signals are propagated into the waveguide. The FSS's 130, 135 can be positioned within the waveguide 100 at any desired orientation. In one arrangement, the FSS's 130, 135 can be positioned longitudinally within the waveguide, parallel to outer surfaces 110, 120. For instance, FSS's 130, 135 having FSS elements 145 can be tuned to pass signals having a wavelength $\lambda_c$, and reflect other signals having a wavelength $\lambda_{c'}$, for example where $\lambda_{c'}=2a'$. Accordingly, the effective width of the waveguide can be a' when a signal having a wavelength $\lambda_{c'}$ is propagated through the waveguide. Notably, additional FSS's also can be provided to support additional modes. In consequence, the waveguide can be optimized to support multiple dominant modes. The FSS elements can be conductive elements or apertures in a conductive surface.

Figure 2:
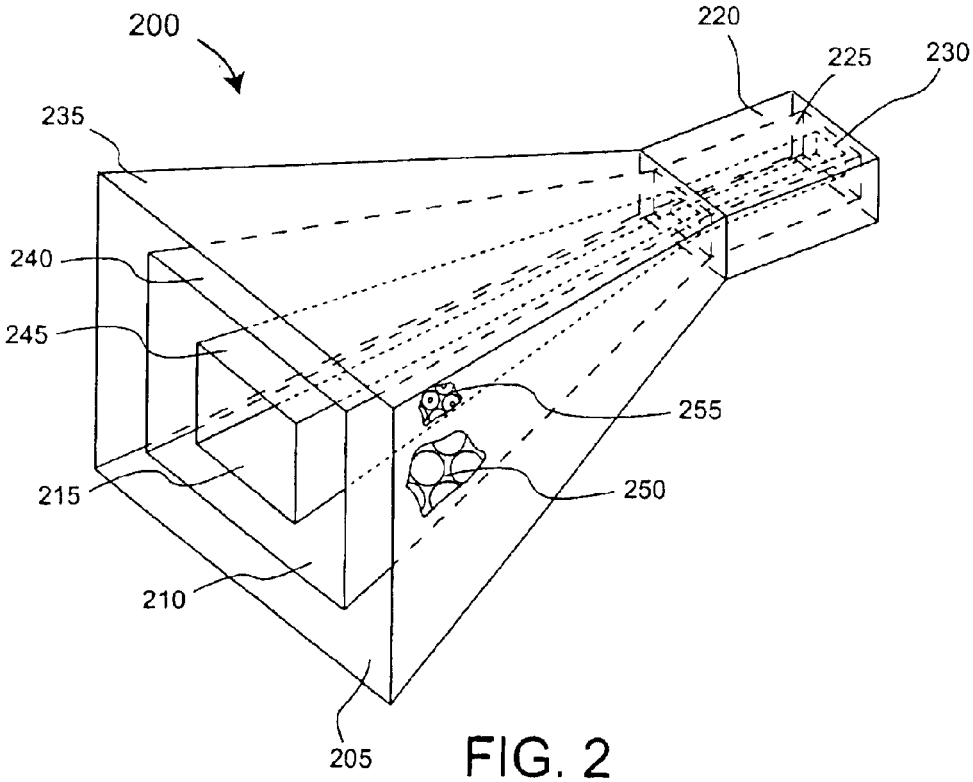
FIG. 2 is a perspective view of a multi-band horn antenna that is useful for understanding the present invention.

Referring to FIG. 2, an exemplary waveguide in the form of a multi-band horn antenna (multi-band horn) 200 incorporating FSS's is shown. Although the multi-band horn 200 shown has a pyramidal shape, the skilled artisan will appreciate that horns are available in a number of different shapes and the invention is not so limited. For example, the horn can be cylindrical, conical, parabolic, or any other suitable shape.

The multi-band horn 200 can include a first horn section 205 and a second horn section 210 which is concentrically disposed within the first horn section 205. The first horn section 205 can be operatively connected to a first waveguide 220. A second waveguide 225, to which the second horn section 210 is operatively connected, can be concentrically disposed within the first waveguide 220. The waveguides 220 and 225 can feed signals to the first horn section 205 and the second horn section 210, respectively. Hereinafter, the first horn section 205 and first waveguide 220 are collectively referred to as first horn 235. Also, the second horn section 210 and second waveguide 225 are collectively referred to as second horn 240.

The first horn 235 can comprise conductive surfaces, dielectric surfaces, FSS's, a combination of such surfaces, and/or any other suitable surface. For example, the first horn 235 can comprise FSS's designed to reflect signals only in the frequency band that the first horn 235 is designed to operate. Accordingly the FSS's can still provide signal reflection required for optimum horn efficiency, while the radar signature and broadband reflection of the multi-band horn 200 outside of the horn's operating band can be minimized. This can be a very useful feature if the multi-band horn 200 is operating proximate to other RF equipment which may be adversely affected by the presence of a broadband reflective surface. Further, a reduced radar signature can be beneficial if the multi-band horn 200 is to be used with a vehicle or craft intended to have a small radar signature.

The effective dimensions of the multi-band horn 200 can be changed when certain types of signals are transmitted or received by the multi-band horn 200. For instance, the second horn 240 can comprise a FSS having FSS elements 250. The FSS elements 250 can be tuned to reflect signals in a frequency band which is different than the operating frequency band of the first horn 235, while being transparent to signals in the operating frequency band of the first horn 235. Accordingly, the second horn 210 can increase the operational frequency range of the multi-band horn 200 without adversely affecting operational performance of the first horn 235.

Additional horns and waveguides can be incorporated into the multi-band horn 200. For example, a third horn section 215 can be disposed within the second horn section 210, a fourth horn (not shown) can be disposed within the third horn section 215, and so on. Likewise, a third waveguide 230 can be disposed within the second waveguide 225, etc. The third horn section 215 and third waveguide 230 can form a third horn 245.

Each successive horn can be designed using an FSS to operate at a different frequency than the other horns. Generally, the operational frequency should increase as the horns become smaller. For proper horn operation, it is preferred that the third horn 245 be transparent to the operating frequency bands of both the first horn 235 and the second horn 240. For example, the FSS of the third horn 245 can include FSS elements 255 which are reflective in the operational frequency band at which the third horn 245 operates, but pass frequency bands at which the first horn 235 and second horn 240 operate. Likewise, if a fourth horn is provided, the fourth horn should be transparent to the operating frequency bands of the first horn 235, the second horn 240 and the third horn 245, etc.

Frequency Selective Surfaces

Figure 3A:
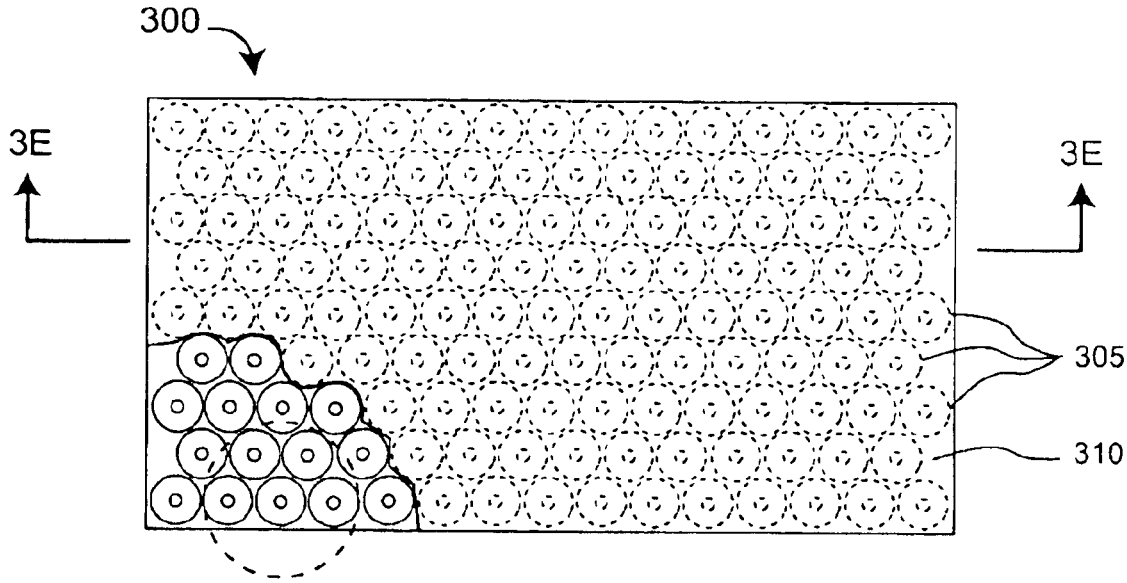
FIG. 3A is a partial cutaway view of an exemplary frequency selective surface (FSS) which can be used in the multi-band horn antenna of FIG. 2.

Referring to FIG. 3A, an exemplary FSS 300 for use as a surface of the third horn 245 within the multi-band horn 200, or as a wall within the waveguide 100 is shown. The FSS 300 can comprise a substrate 310 having a high permittivity and/or high permeability. For instance, the permittivity and/or permeability can be greater than 3. Since the propagation velocity of a signal traveling through a medium is equal to $c/\sqrt{\mu_r \epsilon_r}$, where $\mu_r$ is the relative permeability of the medium and $\epsilon_r$ is the relative permittivity (dielectric constant) of the medium, increasing the permeability and/or permittivity in the substrate 310 decreases propagation velocity of the signal in the substrate 310, and thus the signal wavelength.

In FIG. 3A a portion of the substrate 310 is shown cut away to reveal the FSS elements 305. An FSS element typically resonates at a signal wavelength which is proportional to the size of the element, for example when the FSS element is one-half of the signal wavelength. Hence, as the signal wavelength is decreased, the size of the FSS element can be reduced. Accordingly, the size of FSS elements 305 can be reduced by increasing the permeability and/or permittivity, thereby enabling the FSS elements to be spaced closer together. The reduction in inter-element spacing can be proportional to the decrease in element size. Accordingly, providing a substrate 310 with an increased permittivity and/or permeability enables the FSS elements 305 to be spaced closer together than would be possible on a conventional circuit board.

For example, if the relative permittivity of the substrate 310 is 50 and the relative permeability is 1, the propagation velocity of a signal within the substrate will be approximately 14% of the propagation velocity in air. The size of the FSS elements 305 which are tuned for a particular frequency can be decreased accordingly. Thus, the inter-element spacing of the FSS elements 305 can be reduced to a distance which is 14% of the distance that the inter-element spacing would be using a substrate having a relative permittivity and a relative permeability equal to 1. Further, if the relative permittivity remains at 50 and the relative permeability increases to 50, the size of the FSS elements can be reduced to 2% of what their size would be on a substrate having both a relative permittivity and a relative permeability equal to 1. Hence, the inter-element spacing of the FSS elements 305 can be reduced accordingly, for instance to 2% of the distance that the inter-element spacing would be using a substrate having a relative permittivity and a relative permeability equal to 1.

Figure 6A:
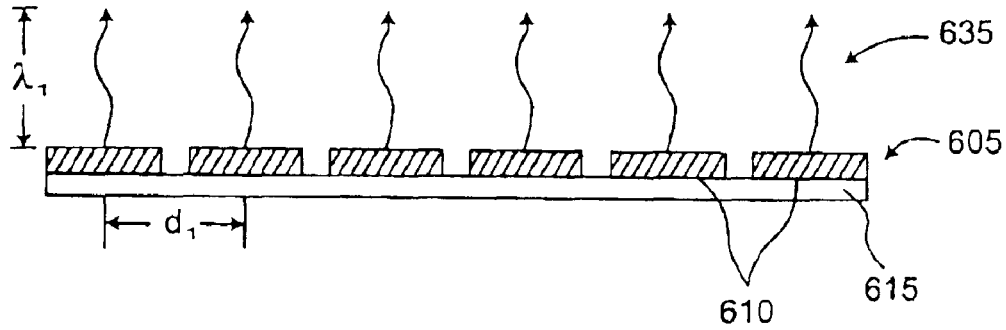
FIG. 6A (Prior Art)
FIG. 6A is an exemplary cross sectional view of a conventional FSS of the prior art.
Figure 6B:
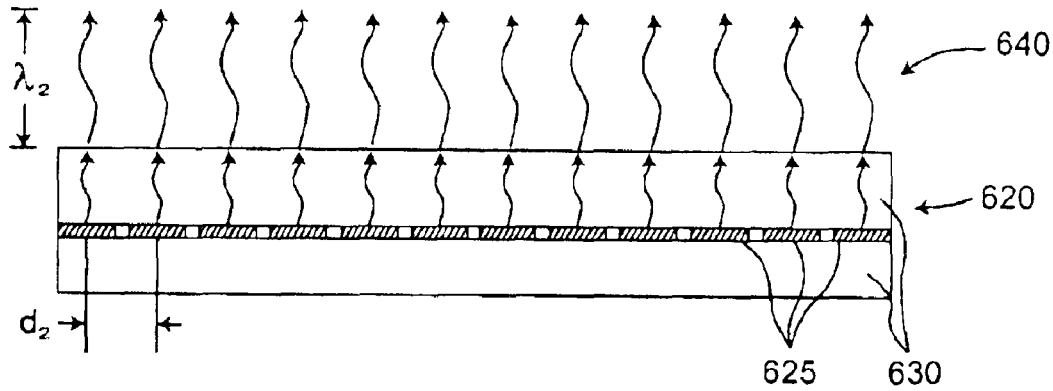
FIG. 6B is an exemplary cross sectional view of an FSS having increased permittivity and/or permeability that is useful for understanding the present invention.

The reduction of inter-element spacing increases the operational bandwidth and performance of the FSS, as can be shown by making reference to FIGS. 6A and 6B. For exemplary purposes, FIG. 6A is a FSS 605 having FSS elements 610 and a low permittivity substrate 615, for instance having a relative permittivity of 3. FSS 620 having FSS elements 625 can have high permittivity substrates 630, for instance having a relative permittivity of 50. The operation of the FSS elements 610, 625 as reflectors can be modeled as point sources. Larger FSS elements 610 result in greater distance between point sources as compared to smaller FSS elements 625. Notably, as RF energy 640 transitions from FSS 620 to a second medium, such as free space, the wavelength of the RF energy 640 increases. In particular, the ratio $(\lambda_2/d_2)$ of the wavelength $\lambda_2$ of RF energy 640 to the spacing $d_2$ between centers of FSS elements 625 is significantly greater than the ratio ($\lambda_1/d_1$) of the wavelength $\lambda_1$ of RF energy 635 to the spacing $d_1$ between centers of FSS elements 610. For example, in a preferred arrangement the ratio ($\lambda_2/d_2$) is at least two.

A greater ratio of wavelength to element spacing ($\lambda_2/d_2$) reduces the scattering of electromagnetic energy in uncontrolled directions, thereby virtually eliminating the occurrence of grating lobes, referred to as uncontrolled radiation, which can occur using typical FSS inter-element spacing. Grating lobes, which result from the array lattice geometry, are moved to higher frequencies as the inter-element spacing is reduced. Accordingly, the grating lobes are effectively moved out of the frequency band of operation. An increased ratio ($\lambda_2/d_2$) also improves FSS performance with respect to RF angles of incidence, which vary significantly from the performance at normal incidence. For example, the performance of the FSS can be optimized for improved broadband performance for RF signals having an angle of incidence between about 20 to 40 degrees relative to a plane which is perpendicular to the surface of the FSS. For instance, performance can be improved over a frequency band having a percentage bandwidth of greater than 45%. As defined herein, percentage bandwidth (% BW) is given by the equation $\% BW=(BW/f_c)\times 100$, where BW is the operational bandwidth of the FSS and $f_c$ 1 is the operational center frequency of the FSS. Accordingly, the present invention enables a waveguide or horn antenna designer to optimize the size and separation of the FSS elements based on the angles of incidence that will be experienced in operation. The optimum size, spacing, and geometry of FSS elements for a particular FSS design can be determined empirically or with the use of a computer program which performs electromagnetic field and wave analysis using the Periodic Moment Method (PMM). The theory is based on a plane wave expansion technique which allows each infinite array of scatterers to be modeled by a single element called the reference element.

Figure 3B:
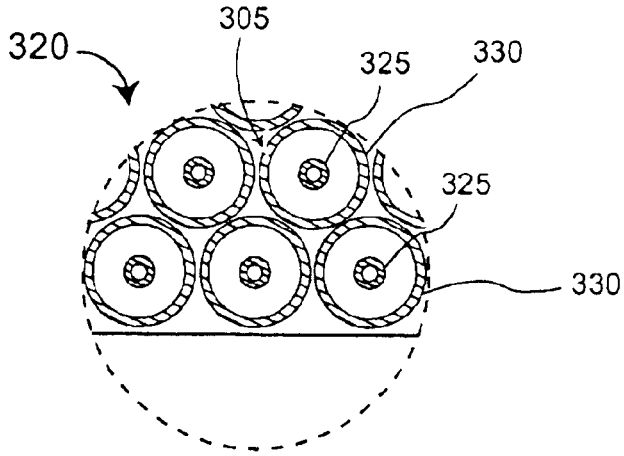
FIG. 3B is an enlarged view of the FSS elements of FIG. 3A.

FIG. 3B shows an enlarged view 320 of the FSS elements 305 of FIG. 3A. As noted, the FSS elements 305 can be apertures in a conductive surface. For instance, the FSS elements can be apertures etched from a metalization layer of a substrate. The FSS elements also can be conductive elements. At this point it should be noted that although FSS elements 305 are shown as concentric circular rings, the invention is not so limited and any suitable FSS elements can be used.

Examples of the FSS elements which can be used are dipoles, tripoles, anchors, cross-dipoles, and Jerusalem crosses. Further, the FSS elements can be square rings, hexagons, loaded tripoles, four legged loaded dipoles, elliptical rings, elliptical hexagons, and concentric versions of such shapes. Moreover, the FSS elements can be combinations of element types, for example nested tripoles, nested anchor hexagons and 4-legged nested loaded dipoles. Such FSS element structures work well both in applications using apertures (slot type elements) and in applications using conductive elements. Conductive patch elements also can be used, for instance square patches, circular patches, and hexagonal patches. Still, there are a myriad of other FSS element types which can be used.

In the case that the FSS elements are apertures in a conductive surface, as shown in FIG. 3B, the FSS elements can be any suitable apertures which can pass and reflect signals propagating at desired frequency bands. In the case that FSS elements 305 are selected to pass two or more specific frequency bands, concentric apertures can be a suitable FSS element choice. For example an inner aperture 325 and an outer aperture 330, each of which are tuned to pass a different frequency band, can be used. Accordingly, the FSS 300 is suitable for use as surfaces of the third horn 245 or as walls of the waveguide 100. For instance, the inner aperture 325 can be selected to pass a frequency band from 20.2 GHz to 21.2 GHz, which can be the operational frequency band of the second horn 240, and the outer aperture 330 can be selected to pass a frequency band from 7.25 GHz to 8.4 GHz, which can be the operational frequency band of the first horn 235. Further, the FSS elements can be selected to reflect a frequency band from 30 GHz to 31 GHz, which can be the operational frequency band of the third horn 245.

The relative permittivity of the substrate 310 for FSS 300 should be considered when selecting the outer and inner diameters of the inner and outer element apertures 325, 330 to insure the apertures 325, 330 pass the proper frequency bands. For example, if the relative permittivity of the substrate 310 is 50, the inner diameter of inner aperture 325 could be 4 mils and the outer diameter of inner aperture 325 could be 9 mils to achieve a passband of 20.2 GHz to 21.2 GHz. Further, the inner diameter of outer aperture 330 could be 36 mils and the outer diameter of outer aperture 330 could be 41 mils to achieve a passband of 7.25 GHz to 8.4 GHz.

Figure 3C:
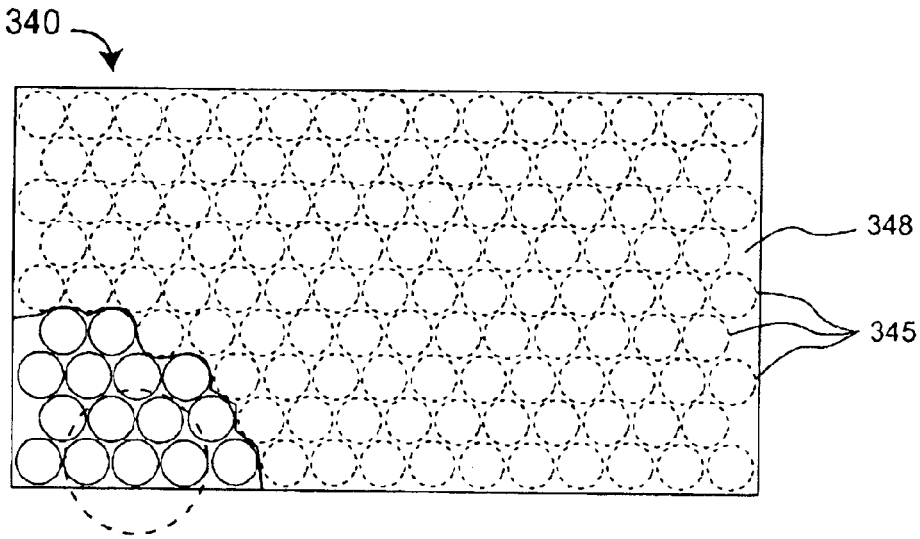
FIG. 3C is a partial cutaway view of another exemplary FSS which can be used in the multi-band horn antenna of FIG. 2.
Figure 3D:
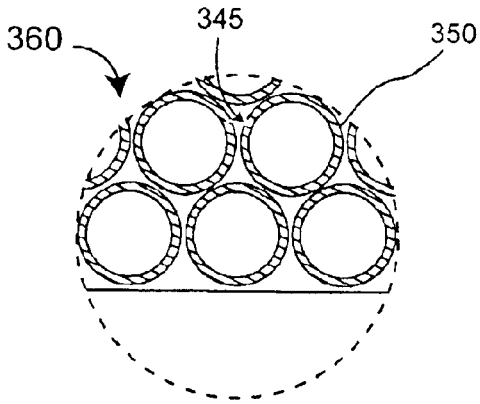
FIG. 3D is an enlarged view of the FSS elements of FIG. 3C.
Figure 3E:
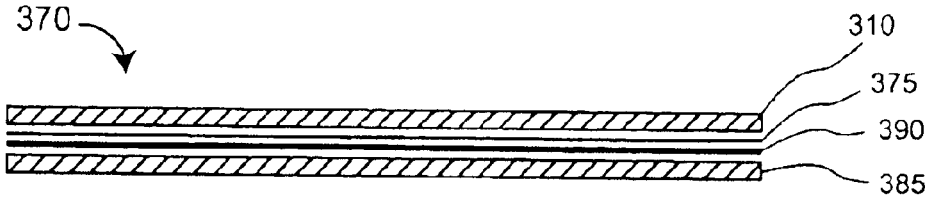
FIG. 3E is a cross sectional view of the FSS of FIG. 3A taken along section lines 3E—3E.

FIG. 3E shows an exploded partial cross sectional view 370 of the FSS 300 of FIG. 3A taken along section line 3E—3E. As noted, the FSS 300 can include an array of FSS elements, which in the present example are concentric apertures in a conductive surface 375. The conductive surface 375 can be a metallization layer which has been applied to one or more layers of dielectric substrate 390. The dielectric substrate 390 can be, for example, polyester, polypropylene, polystyrene, polycarbonate, or any other suitable dielectric material.

Referring to FIG. 3C, an exemplary FSS 340 which can be used as a surface of the second horn 245 or as walls 130, 135 of waveguide 100 is shown. A portion of the substrate 348 comprising the FSS 340 is shown cut away in FIG. 3C to reveal the FSS element 345. FIG. 3D shows an enlarged view 360 of the FSS elements 345 of FIG. 3D. In contrast to the FSS elements 305 used for the third horn 245, the FSS elements 345 can comprise a single aperture 350 since the second horn need only pass a single frequency band, which in this example is the operational frequency band of the first horn 235.

Accordingly, for our example, the FSS elements 345 can be selected to pass a frequency band from 7.25 GHz to 8.4 GHz, while reflecting a frequency band from 20.2 GHz to 21.2 GHz. For instance, if the relative permittivity of substrate 348 is 50, the inner diameter of inner aperture 350 could be 4 mils and the outer diameter of inner aperture 350 could be 9 mils.

As noted, it may be desirable for the substrate 310 to have a high permittivity and/or permeability. For instance, at least one of the permittivity and permeability can be greater than 3. In a preferred arrangement, the upper and lower substrates 310, 385 can be provided in the form of a high permittivity and/or high permeability material. In most cases it may preferable to utilize a low loss material to minimize power losses. For instance, the loss tangent can be less than 0.005. Nonetheless, there may be some applications where a certain amount of power loss is acceptable, or even desirable. In such cases, a material having a loss tangent equal to or higher than 0.005 can be provided. Further, the upper and lower substrates 310, 385 can be optimized to match the impedance of the FSS 300 to the impedance of free space, which is approximately 377 ohms, or any other medium in which the FSS 300 will be operated. High dielectric materials are discussed below.

Figure 4A:
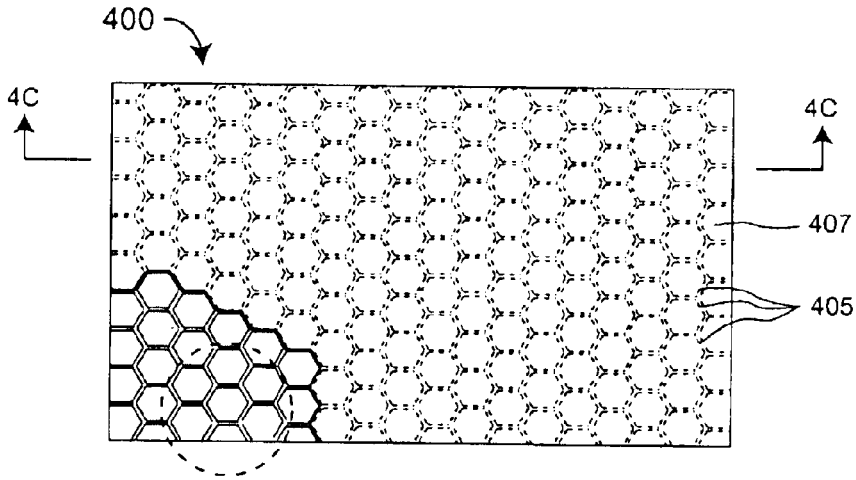
FIG. 4A is a partial cutaway view of yet another exemplary FSS which can be used in the multi-band horn antenna of FIG. 2.
Figure 4B:
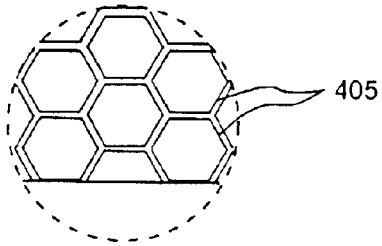
FIG. 4B is an enlarged view of the FSS of FIG. 4A.

Referring to FIG. 4A, an alternate arrangement for an FSS 400 is shown wherein the FSS uses conductive elements 405. Such an arrangement can be used for the first, second or third horns, so long as the conductive elements 405, spacing between arrays of conductive elements 405, and substrate materials are properly selected. A portion of the substrate 407 comprising the FSS 400 has been cut away to reveal the underlining conductive elements. An enlarged view of the conductive elements 405 is shown in FIG. 4B. The conductive elements 405 can be conductors having any suitable FSS geometry. For instance, the FSS elements 405 can be hexagons, as shown. The conductive elements should be selected to resonate at a particular frequency at which the FSS will become reflective. For instance, FSS elements for use in a horn which operates in the frequency band from 30 GHz to 31 GHz should resonate over that frequency band. Likewise, FSS elements for use in a horn which operates in a frequency band from 20.2 to 21.2 GHz should resonate over that frequency band, and so on. Further, the inter-element spacing should be optimized to eliminate or minimize grating lobes and provide optimum performance for the angles of incidence that will be experienced. Optimum inter-element spacing can be determined empirically or with the use of a computer program that performs electromagnetic field and wave analysis using the periodic moment method.

Figure 4C:
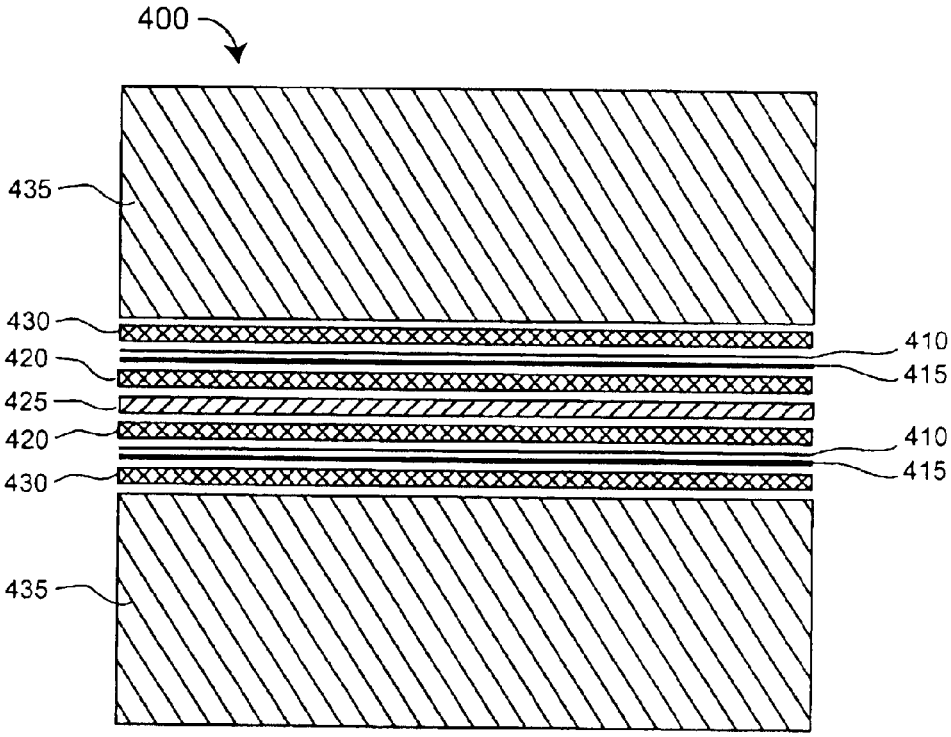
FIG. 4C is a cross sectional view of the FSS of FIG. 4A taken along section lines 4C—4C.

An exploded partial cross sectional view of the FSS of FIG. 4A taken along section lines 4C—4C is shown in FIG. 4C. In such an arrangement, it can be advantageous to stack multiple arrays 410 of conductive elements. As noted for other FSS types, the arrays 410 of conductive elements can be formed by a metallization layer deposited on a substrate 415. Further, the arrays 410 can be separated by one or more substrate layers 420, 425. The substrate relative permittivity and thickness of the substrate layers 420, 425 can be selected to create interference nulls at a fundamental frequency at which the FSS 400 should become transparent to propagating signals. The interference nulls result in a bandpass condition for the FSS 400. The permittivity and thicknesses of the substrate layers 420, 425 can be determined empirically or with the use of a computer program which performs electromagnetic field and wave analysis using the Periodic Moment Method.

The FSS 400 also can pass harmonics of the fundamental frequency. For example, if the fundamental frequency is 7.7 GHz, the FSS can pass 15.4 GHz, 23.1 GHz, and so on. Although 30.8 GHz is a harmonic of 7.7 GHz, in the present example 30.8 GHz can be within the frequency band at which the FSS elements are designed to be reflective. Hence, the FSS elements will be reflective for that particular frequency.

Additional substrates 430, 435 also can be provided. As noted, the additional substrates can be used to increase the overall permittivity and/or permeability of the FSS 400. For instance, the additional substrates can be used to match the impedance of the FSS 400 to the impedance of free space, or any other medium in which the FSS 400 will be operated.

Waveguide Assembly

Figure 5A:
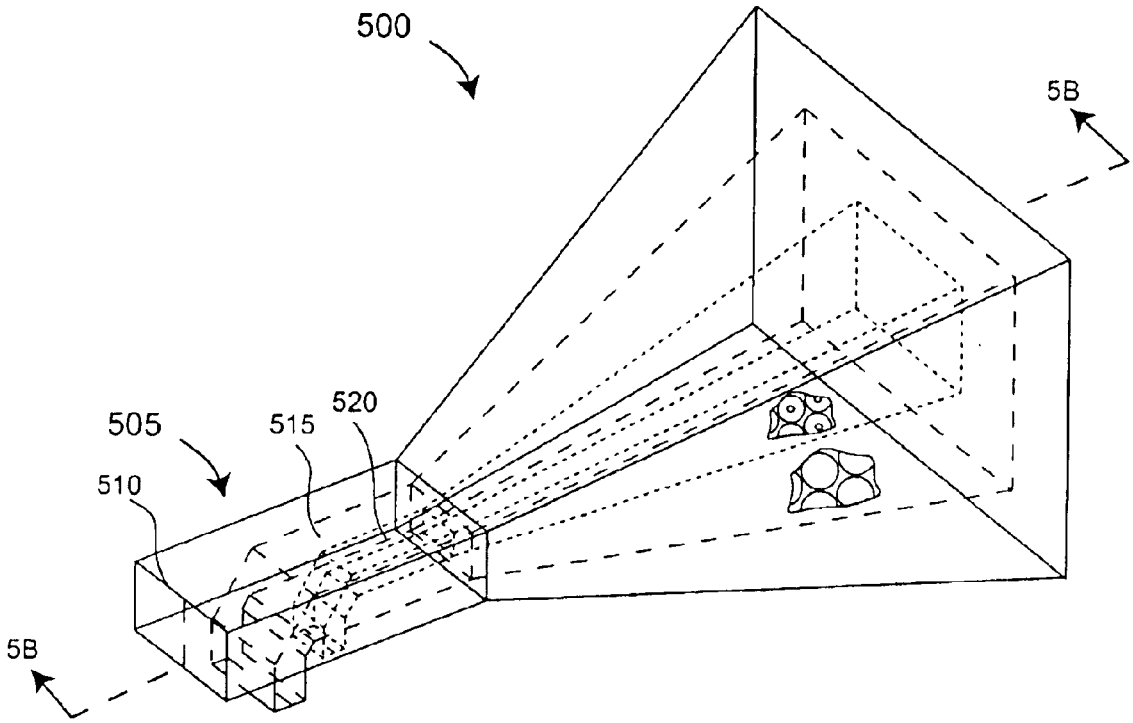
FIG. 5A a perspective view of a multi-band horn antenna having an alternate waveguide arrangement that is useful for understanding the present invention.
Figure 5B:
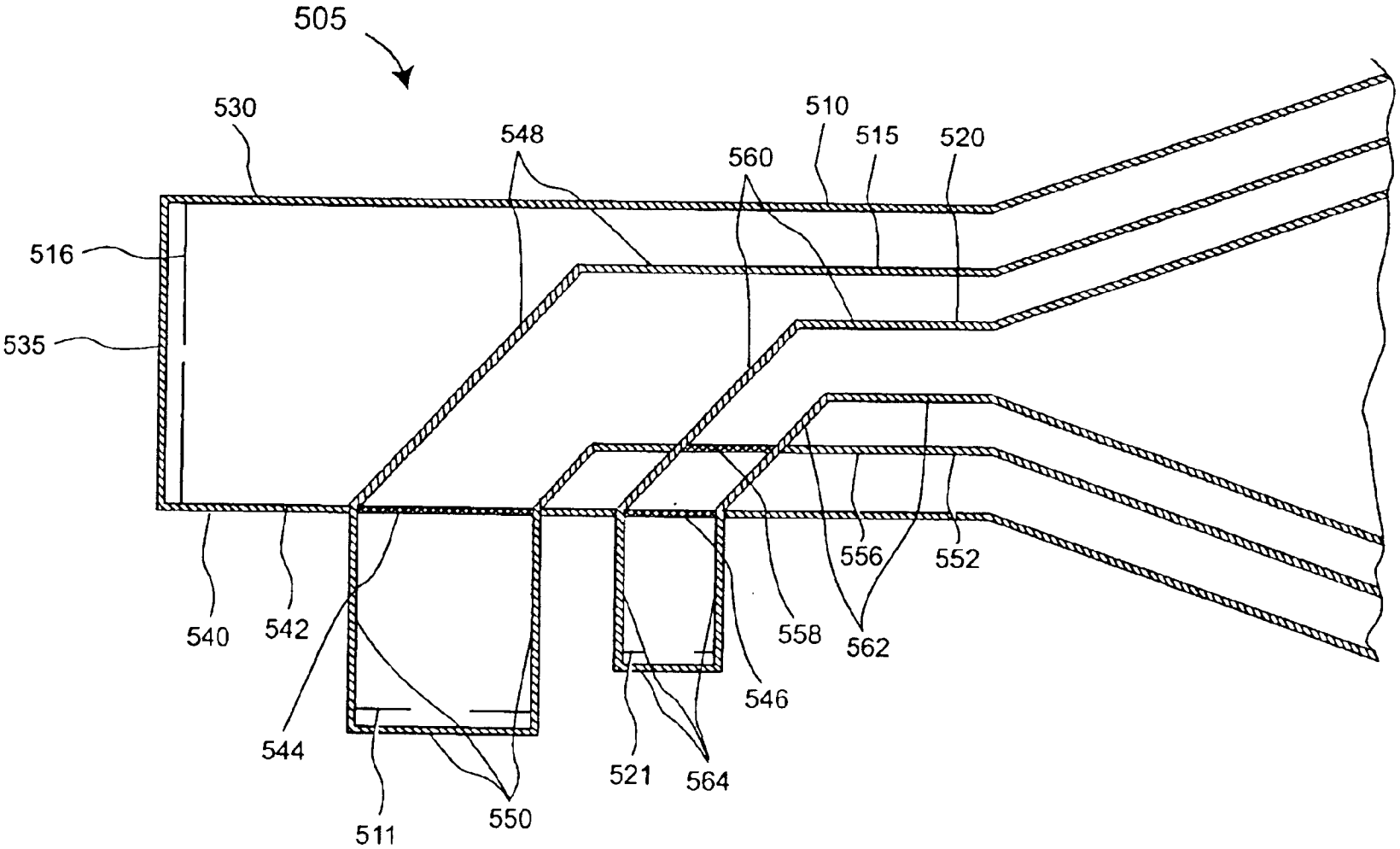
FIG. 5B is a cross sectional view of a waveguide assembly of the multi-band horn antenna of FIG. 5A taken along section lines 5B—5B.

Referring to FIG. 5A, a multi-band horn antenna 500 having an alternate waveguide assembly 505 is presented. The waveguide assembly 505 can provide excellent horn feed characteristics for the multi-band horn antenna 500 by minimizing interactions of the waveguide assemblies with RF signals outside each waveguide's respective operational frequency range. A cross sectional view of the waveguide assembly 505 taken along section lines 5B-5B is shown in FIG. 5B. The waveguide assembly can include multiple concentric waveguides, for instance first waveguide 510, second waveguide 515 and third waveguide 520. Further, signal probes 511, 516, 521 can be disposed within each of the respective waveguides 510, 515, 520 for generating RF signals within the waveguides 510, 515, 520.

The first waveguide 510 can comprise a plurality of surface materials. For instance, the first waveguide 510 can include conductive surfaces, dielectric surfaces, FSS's, or a combination of such surfaces. In one arrangement, waveguide walls (walls) 530, 535 can be conductive. Wall 540 can comprise conductive portions 542 and FSS portions 544, 546. FSS portion 544 can be disposed at an intersection of waveguide 510 and waveguide 515. FSS portion 544 can be configured to reflect RF signals in the operational frequency range of waveguide 510 and pass RF signals in the operational frequency range of waveguide 515. Likewise, FSS portion 546 can be disposed at an intersection of waveguide 510 and waveguide 520. Further, FSS portion 546 can be configured to reflect RF signals in the operational frequency range of waveguide 510 and pass RF signals in the operational frequency range of waveguide 520.

Waveguide 515 can include walls 548, 550, 552. Walls 550 can be conductive. Wall 552 can include a portion 558 which intersects waveguide 520, and a remaining non-intersecting portion 556. Walls 548, 550 and portion 556 of wall 552 can be FSS's which pass RF signals in the operational frequency range of waveguide 510, but are reflective to RF signals in the operational frequency range of waveguide 515. FSS portion 558 of wall 552 also can pass RF signals in the operational frequency range of the waveguide 510 and can be reflective to RF signals in the operational frequency range of waveguide 515. Further, FSS portion 558 also can pass RF signals in the operational frequency range of the waveguide 520.

Lastly, waveguide 520 can include waveguide walls 560, 562, 564. Walls 564 can be conductive, while walls 560, 562 can be FSS's which are reflective to RF signals in the operational frequency range of the waveguide 520 and pass RF signals in the operational frequency ranges of the waveguides 510, 515. Accordingly, the respective waveguides can operate with little or no interference resulting from the multi-band configuration.

High Dielectric Materials

One example of a material which can be used to increase the relative permittivity of the substrates is titanium oxide ($TiO_2$). $TiO_2$ has a relative permittivity (dielectric constant) near 86 and a loss tangent of 0.0002 when measured perpendicular to the c-axis of the material, and a dielectric constant near 170 and loss tangent of 0.0016 when measured parallel to the c-axis. Another material which can be used is barium oxide (BaO) crystal, which has a dielectric constant of 34 and a loss tangent of 0.001. Still, many other materials are commercially available which can be used, for example SB350, SL390 and SV430 dielectric ceramics, each available from Kyocera Industrial Ceramics Corp. of Vancouver, Wash.; E2000, E3000 and E4000 ceramics available from Temex Corp. of Sevres Cedex, France; C-Stock AK available from Cuming Corp. of Avon, Mass.; and RT/6010LM available from Rogers Corp. of Rogers, Conn.

Meta-materials also can be used to provide substrates having medium to high relative permittivity and/or relative permeability. As defined herein, the term "meta-materials" refers to composite materials formed from the mixing or arrangement of two or more different materials at a very fine level, such as the angstrom or nanometer level. Meta-materials allow tailoring of electromagnetic properties of the composite. The materials to be mixed can include a plurality of metallic and/or ceramic particles. Metal particles preferably include iron, tungsten, cobalt, vanadium, manganese, certain rare-earth metals, nickel or niobium particles.

The particles are preferably nanometer size particles, generally having sub-micron physical dimensions, hereafter referred to as nanoparticles. The particles can preferably be organofunctionalized composite particles. For example, organofunctionalized composite particles can include particles having metallic cores with electrically insulating coatings or electrically insulating cores with a metallic coating.

Magnetic metamaterial particles that are generally suitable for controlling magnetic properties of dielectric layer for a variety of applications described herein include ferrite organoceramics (FexCyHz)-(Ca/Sr/Ba-Ceramic). These particles work well for applications in the frequency range of 8–40 GHz. Alternatively, or in addition thereto, niobium organoceramics (NbCyHz)-(Ca/Sr/Ba-Ceramic) are useful for the frequency range of 12–40 GHz. The materials designated for high frequency are also applicable to low frequency applications. These and other types of composite particles can be obtained commercially.

In general, coated particles are preferable for use with the present invention as they can aid in binding with a polymer matrix or side chain moiety. Particles can be applied to a substrate by a variety of techniques including polyblending, mixing and filling with agitation. For example, a dielectric constant may be raised from a value of 2 to as high as 10 by using a variety of particles with a fill ratio of up to about 70%. Metal oxides useful for this purpose can include aluminum oxide, calcium oxide, magnesium oxide, nickel oxide, zirconium oxide and niobium (II, IV and V) oxide. Lithium niobate (LiNbO3), and zirconates, such as calcium zirconate and magnesium zirconate, also may be used.

The selectable dielectric properties can be localized to areas as small as about 10 nanometers, or cover large area regions, including the entire board substrate surface. Conventional techniques such as lithography and etching along with deposition processing can be used for localized dielectric and magnetic property manipulation.

Materials can be prepared mixed with other materials or including varying densities of voided regions (which generally introduce air) to produce effective relative dielectric constants in a substantially continuous range from 2 to about 2650, as well as other potentially desired substrate properties. For example, materials exhibiting a low dielectric constant (<2 to about 4) include silica with varying densities of voided regions. Alumina with varying densities of voided regions can provide a relative dielectric constant of about 4 to 9. Neither silica nor alumina have any significant magnetic permeability. However, magnetic particles can be added, such as up to 20 wt. %, to render these or any other material significantly magnetic. For example, magnetic properties may be tailored with organofunctionality. The impact on dielectric constant from adding magnetic materials generally results in an increase in the dielectric constant.

Medium dielectric constant materials have a relative dielectric constant generally in the range of 70 to 400+/−10%. As noted above these materials may be mixed with other materials or voids to provide desired effective dielectric constant values. These materials can include ferrite doped calcium titanate. Doping metals can include magnesium, strontium and niobium. These materials have a range of 45 to 600 in relative magnetic permeability.

For high dielectric constant applications, ferrite or niobium doped calcium or barium titanate zirconates can be used. These materials have a relative dielectric constant of about 2200 to 2650. Doping percentages for these materials are generally from about 1% to 10%. As noted with respect to other materials, these materials may be mixed with other materials or voids to provide desired effective dielectric constant values.

These materials can generally be modified through various molecular modification processing. Modification processing can include void creation followed by filling with materials such as carbon and fluorine based organo functional materials, such as polytetrafluoroethylene PTFE.

Alternatively or in addition to organofunctional integration, processing can include solid freeform fabrication (SFF), photo, UV, x-ray, e-beam or ion-beam irradiation. Lithography can also be performed using photo, UV, x-ray, e-beam or ion-beam radiation.

Liquid crystal polymers (LCP's) also can be used in the upper and/or lower substrate 310, 385. LCP's, which are characterized as having liquid crystal states and have a number of unique characteristics that result in physical properties that can be significantly responsive to a variety of energetic stimuli. The liquid crystal state is a distinct phase of matter, referred to as a mesophase, observed between the crystalline (solid) and isotropic (liquid) states. Liquid crystals are generally characterized as having long-range molecular-orientational order and high molecular mobility. There are many types of liquid crystal states, depending upon the amount of order in the material.

Liquid crystals are anisotropic materials, and the physical properties of the system vary with the average alignment with the preferred orientation direction of the molecules, referred to as the director. If the alignment is large, the material is very anisotropic. Similarly, if the alignment is small, the material is almost isotropic.

The nematic liquid crystal phase is characterized by molecules that have no positional order but tend to point in the same direction (along the director). As the temperature of this material is raised, a transition to a black, substantially isotropic liquid can result.

The smectic state is another distinct mesophase of liquid crystal substances. Molecules in this phase show a higher degree of translation order compared to the nematic state. In the smectic state, the molecules maintain the general orientational order of nematics, but also tend to align themselves in layers or planes. Motion can be restricted within these planes, and separate planes are observed to flow past each other. The increased order means that the smectic state is more solid-like than the nematic. Many compounds are observed to form more than one type of smectic phase.

Another common liquid crystal state can include the cholesteric (chiral nematic) liquid crystal phase. The chiral nematic state is typically composed of nematic mesogenic molecules containing a chiral center that produce intermolecular forces that favor alignment between molecules at a slight angle to one another. Columnar liquid crystals are different from the previous types because they are shaped like disks instead of long rods. A columnar mesophase is characterized by stacked columns of molecules.

Many liquid crystal polymers provide substantially alignable regions therein. For example, some LCP's are responsive to electric and magnetic fields, and produce differing responses based on the orientation of the applied fields relative to the director axis of the LCP.

Applying an electric field to a liquid crystal molecule with a permanent electric dipole can cause the dipole to align with the field. If the LCP molecule did not originally have a dipole, a dipole can be induced when the field is applied. This can cause the director of the LCP to align with the direction of the electric field being applied. As a result, physical properties, such as the dielectric constant of the LCP can be controlled using an electrical field. Only a very weak electric field is generally needed to accomplish this in the LCP. In contrast, applying an electric field to a conventional solid has little effect because the molecules are held in place by their bonds to other molecules, unless the solid is ferroelectric or ferromagnetic. Similarly, in liquids, the high kinetic energy of the molecules can make orienting a liquid's molecules by applying an electric field difficult with prior art technology.

Since the electric dipole across LCP molecules varies in degree along the length and the width of the molecules, some LCP's require less electric field and some require much more in order to align the director. The ratio of electric dipole per unit volume of crystal to the field strength referred to as the electric susceptibility and provides a measure of how easy it is to electrically polarize the material. LCP responses to an electrical field can be referred to as a liotropic (sometimes written as lyotropic) response.

Magnetic dipoles also can be inherent, or more likely, can be induced in the LCP by applying a magnetic field. Thus, there can be a corresponding magnetic susceptibility associated with the LCP's. As with an applied electrical field, application of a magnetic field across an LCP can be used to change or control physical properties of the LCP, such as the dielectric constant. In addition to changing physical properties in response to electrical and magnetic fields, temperature and photonic radiation can also be used for modification of dielectric properties of the LCP. LCP responses to heat can be referred to as thermotropic responses.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A waveguide comprising:

at least one outer surface defining a waveguide cavity; and at least one inner surface positioned within said waveguide cavity, wherein said inner surface comprises a frequency selective surface (FSS) having a plurality of frequency selective surface elements coupled to at least one substrate, said substrate defining a first propagation medium such that an RF signal having a first wavelength in said first propagation medium can pass through said frequency selective surface;

wherein said frequency selective surface is coupled to a second propagation medium such that in said second propagation medium said RF signal has a second wavelength which is at least twice as long as a physical distance between centers of adjacent ones of said frequency selective surface elements;

wherein said substrate comprises at least one material selected from the group consisting of a meta-material and a liquid crystal polymer.

2. The waveguide of claim 1, wherein said second wavelength is different than said first wavelength.

3. The waveguide of claim 1, wherein said substrate comprises a dielectric having at least one of a relative permittivity and a relative permeability which is greater than 3.

4. The waveguide of claim 1, wherein said frequency selective surface comprises a plurality of dielectric layers.

5. The waveguide of claim 1, wherein said frequency selective surface comprises at least one dielectric layer for matching an impedance of said first propagation medium to an impedance of said second propagation medium.

6. The waveguide of claim 1, wherein said frequency selective surface elements comprise apertures in a conductive surface.

7. The waveguide of claim 1, wherein said frequency selective surface elements comprise conductive elements.

8. An antenna for microwave radiation comprising:

a first horn; and at least a second horn positioned within said first horn, said second horn comprising at least one frequency selective surface having a plurality of frequency selective surface elements coupled to at least one substrate, said substrate defining a first propagation medium such that an RF signal having a first wavelength in said first propagation medium can pass through said frequency selective surface;

wherein said frequency selective surface is coupled to a second propagation medium such that in said second propagation medium said RF signal has a second wavelength which is at least twice as long as a physical distance between centers of adjacent ones of said frequency selective surface elements.

9. The antenna of claim 8, wherein said second wavelength is different than said first wavelength.

10. The antenna of claim 8, further comprising at least a third horn positioned within said second horn, said third horn comprising at least one frequency selective surface.

11. The antenna of claim 8, wherein said substrate comprises a dielectric having at least one of a permittivity and a permeability which is greater than 3.

12. The antenna of claim 8, wherein said frequency selective surface elements comprise apertures in a conductive surface.

13. The antenna of claim 8, wherein said frequency selective surface elements comprise conductive elements.

14. The antenna of claim 8, wherein said frequency selective surface comprises a plurality of dielectric layers.

15. The antenna of claim 8, wherein said frequency selective surface comprises at least one dielectric layer matching an impedance of said first propagation medium to an impedance of said second propagation medium.

16. A waveguide horn antenna comprising, a tapered hollow metallic conductor; and a frequency selective surface comprising a substrate and an array of elements defining at least one wall of said horn, said frequency selective surface positioned for confining and guiding a propagating electromagnetic wave;

said substrate having at least one of a permeability and a permittivity greater than about three.

17. The waveguide horn antenna according to claim 16 wherein said frequency selective surface is comprised of concentric ring slots.

18. A method for improving performance in a horn antenna comprising the steps of:

forming at least one wall of said horn antenna of a frequency selective surface; and selectively reducing at least one grating lobe of said antenna by increasing at least one of a permittivity and a permeability of a substrate comprising said frequency selective surface to a value greater than three.

19. The method according to claim 18 further comprising the step of increasing said value of at least one of said permeability and said permittivity to between about 10 and 100.

20. The method according to claim 18 further comprising the step of reducing at least one grating lobe of said antenna by decreasing a spacing between adjacent elements of said frequency selective surface.

21. A waveguide comprising:

at least one outer surface defining a waveguide cavity; and at least one inner surface positioned within said waveguide cavity arranged parallel to said outer surface, said inner surface comprising a frequency selective surface (FSS) having a plurality of frequency selective surface elements coupled to at least one substrate;

wherein an RF signal having a first wavelength passes through said frequency selective surface and is incident on said at least one outer surface, and an RF signal having a second wavelength does not pass through said inner surface, wherein said inner surface defines a wall of a second waveguide structure.

* * * * *

UNITED STATES PATENT AND TRADEMARK OFFICE

CERTIFICATE OF CORRECTION

PATENT NO. : 6,985,118 B2
APPLICATION NO. : 10/614626
DATED : January 10, 2006
INVENTOR(S) : Zarro et al.

It is certified that error appears in the above-identified patent and that said Letters Patent is hereby corrected as shown below:

On title page [56]:
At the bottom of the Title Page change "21 Claims" to -- 24 Claims --.
Page 2, continued from Field [56], under "FOREIGN PATENT DOCUMENTS" insert --WO 9400892 1/1994--.

Column 7
Line 26, delete "1" after "$f_c$".

Delete Col. 15 line 13 through Col. 16 line 12, insert therefor the following:

--21. The waveguide horn antenna according to claim 16, wherein at least one of said permeability and said permittivity has a value between about 10 and 100.

22. The waveguide horn antenna according to claim 16, wherein at least one of said permittivity and said permeability has a value corresponding to a characteristic impedance for said substrate that is approximately equal to a characteristic impedance of an environment in which said frequency selective surface is operated.--

23. The waveguide horn antenna according to claim 16, wherein a value of at least said permeability and said permittivity are selected for reducing a grating lobe.

UNITED STATES PATENT AND TRADEMARK OFFICE

CERTIFICATE OF CORRECTION

PATENT NO. : 6,985,118 B2
APPLICATION NO. : 10/614626
DATED : January 10, 2006
INVENTOR(S) : Zarro et al.

It is certified that error appears in the above-identified patent and that said Letters Patent is hereby corrected as shown below:

Delete Col. 15 line 13 through Col. 16 line 12, insert therefor the following (cont'd):

24. The method according to claim 18, further comprising selecting said permittivity and said permeability to have a value corresponding to a characteristic impedance for said substrate that is approximately equal to a characteristic impedance of an environment in which said frequency selective surface is operated.--

Signed and Sealed this

Thirteenth Day of November, 2007

JON W. DUDAS
*Director of the United States Patent and Trademark Office*